US005690555A

United States Patent [19]

Lay

[11] Patent Number: 5,690,555

[45] Date of Patent: Nov. 25, 1997

[54] AUTOMATIC TEEING DEVICE AND CAGE FOR CATCHING GOLF BALLS HIT TOWARD THE CAGE

[76] Inventor: William C. Lay, 95 W. 650 South, St. George, Utah 84770

[21] Appl. No.: 707,961

[22] Filed: Aug. 30, 1996

[51] Int. Cl.[6] ..... A63B 57/00

[52] U.S. Cl. ..... 473/137

[58] Field of Search ..... 473/132, 133, 473/134, 135, 136, 137, 150, 182, 184, 195, 196, 197

[56] References Cited

U.S. PATENT DOCUMENTS

| | | | |
|---|---|---|---|
| 1,745,201 | 1/1930 | Alston | 473/197 |
| 1,940,321 | 12/1933 | Pagett | 473/137 |
| 1,948,020 | 2/1934 | Buckingham | 473/137 |
| 4,441,717 | 4/1984 | Willcox | 473/134 |
| 4,541,632 | 9/1985 | Tillery | 473/137 |
| 4,659,081 | 4/1987 | Cook | 473/133 |
| 4,732,391 | 3/1988 | Karr | 473/137 |
| 4,892,318 | 1/1990 | Jennings | 473/137 |
| 5,346,222 | 9/1994 | Luther, Sr. | 473/137 |
| 5,549,518 | 8/1996 | Wang | 473/137 |

*Primary Examiner*—Steven B. Wong

*Attorney, Agent, or Firm*—Terry M. Crellin

[57] ABSTRACT

A golf ball teeing device and associated cage for catching a golf ball it from the teeing device includes a manually actuated trough for teeing one ball after another in succession on a tee to be hit. A cage catches the balls that are hit, and a ball return mechanism returns the balls to the teeing device. The returned balls line up in a row in alignment with a ball entrance of the teeing device. One ball at a time is fed to a ball cavity in the teeing device. The person using the teeing device actuates an elongate trough that is associated with the ball cavity to pivot downwardly allowing the ball in the ball cavity to roll down the trough. A guide on the distal end of the trough sets the ball on a tee, and the trough can then be returned to its ready position in which a new ball is fed to the ball cavity. After hitting the teed ball, the user again actuates the trough to tee the next ball that is to be hit.

25 Claims, 10 Drawing Sheets

AUTOMATIC TEEING DEVICE AND CAGE FOR CATCHING GOLF BALLS HIT TOWARD THE CAGE

BACKGROUND OF THE INVENTION

1. Field of the Invention

The present invention relates to apparatus used to practice hitting a golf ball. In particular, the present invention relates to a novel teeing device that can be activated by a user's golf club to automatically tee a golf ball for the user to hit. In addition, the present invention relates to a cage that can be set up in one's back yard, garage or basement, and which can be used to safely catch golf balls hit toward the cage. The invention further relates to a combination cage and teeing device in which balls hit into the cage are automatically returned to the teeing device so that they can be re-teed and hit one after another, again and again into the cage.

2. State of the Art

Cages for receiving golf balls hit toward the cages are well known in the art. The cages have generally been bulky and required extensive time and effort to erect and dismantle. There are no cages that the inventor is aware that are relatively inexpensive and which can be quickly and easily erected in one's back yard, garage or basement. Further, there are no such cages known to the inventor which can further be quickly dismantled into a concise, rectangular shape that is easily moved and stored.

Automatic teeing devices have also been suggested in the prior art, but because of their complex and expensive nature, such teeing devices have not been commercially successful. There is no teeing device known to the inventor that has the ability to line up golf balls at a ball receiving port in the teeing device, with the teeing device being activated by one's golf club to successively tee one golf ball at a time from the line of golf balls at the receiving port of the teeing device.

OBJECTIVES OF THE INVENTION

A principal objective of the invention is to provide a novel teeing device for automatically teeing a golf ball, wherein the teeing device accepts balls, one at a time, from a line of balls that forms at the ball entrance of the teeing device. The teeing device comprises an elongate trough that pivots downwardly from an upstanding position to a position in which the distal end of the trough is lower than the proximal end so that a golf ball will roll down the trough from the proximal end to the distal end. Gate means are provided adjacent to the distal end of the trough for feeding one ball at a time to a ball cradle at the proximal end of the trough. The gate means prevents a subsequent golf ball from entering the ball cradle until the previous ball has been dispensed from the distal end of the trough and the trough has returned to its upstanding position.

A further objective of the present invention is to provide such a teeing device in which the downward movement of the trough is activated by the user, and the return upward movement of the trough is accomplished by a spring attached to the trough near the proximal end which biases the trough to move to its upwardly extending position when not being activated to move in its downward motion.

A still further objective of the present invention is to provide a teeing device as in the previous paragraph wherein the trough has an engagement member associated therewith that can be engaged by the head of a golf club. The user of the device activates the downward movement of the trough by placing the head of a golf club in the engagement member and rotating the trough downwardly with the golf club.

An additional objective of the present invention is to provide a teeing device as in either of the previous two paragraphs wherein a curved ball transfer tube is associated with the ball entrance of the teeing device. The curved ball transfer tube is of a size to allow a golf ball to roll smoothly through the tube and to allow golf balls to stack up in a single line in the tube. The curved ball transfer tube can either be attached to a shag bag containing golf balls so as to feed a continuous line of balls from the shag bag to the teeing device, or the curved ball transfer tube can extend upwardly in a spiral curve so as to form a continuous line of balls. In either of the latter embodiments, balls are fed continuously to the teeing device, and the gate means feeds one ball at a time to the cradle of the trough.

Another objective of the present invention is to provide a novel cage that can advantageously be used with the teeing device so that balls hit into the cage are automatically returned to the teeing device. In particular, it is advantageous to provide a cage having a back wall and a floor, with the floor slanting towards a ball return device. A ball return track feeds balls from the ball return device to the teeing device. The ball return device is preferably a kick back device, and the ball return track comprise two portions. The first portion of the ball return track slants upwardly from the kick back device so that the distal end of the first portion of the track is at an elevation slightly higher than the ball receiving entrance of the teeing device. The second portion of the ball return track slants downwardly from the distal end of the first portion of the track to the teeing device. Golf balls are first propelled, one at a time, up the first portion of the ball return track by the kick back device. The balls then roll down the second portion of the ball return track under the action of gravity to form a line of balls at the ball entrance of the teeing device.

Still another objective of the present invention is to provide a novel cage for receiving golf balls hit toward the cage. Novel aspects of the cage as will be discussed more fully hereinafter include a floor that slants toward a ball return device, with a ball return track extending forwardly of the cage and from the return device so that golf balls hit into the cage are automatically returned to the area from which the balls are being hit. The cage advantageously has upstanding side walls as well as an upstanding back wall and a top wall. In a preferred embodiment, the floor slants downwardly in a direction toward one of the side walls. A kick back device is provided at the side wall, and means are provided for feeding balls from the sloping floor to the kick back device. A ball return track feeds balls from the ball return device to the teeing device. The ball return track comprise two portions. The first portion of the ball return track slants upwardly from the kick back device so that the distal end of the first portion of the track is at an elevation slightly higher than the kick back device. The second portion of the ball return track slants downwardly from the distal end of the first portion of the track toward the are from which golf balls are being hit. Golf balls are first propelled, one at a time, up the first portion of the ball return track by the kick back device. The balls then roll down the second portion of the ball return track under the action of gravity.

Yet another objective of the present invention is to provide a novel cage for receiving golf balls hit toward the cage in which the cage has upstanding side walls, an upstanding back wall and a top wall. In addition, a deflector net is hung from one side wall of the cage to the other side wall, with the deflector net being spaced from the back wall of the cage by a distance of from about one foot to about three feet. In one embodiment, the deflector net is secured at its upper corners to the upper side edges of the respective side walls of the cage. This allows balls hit high into the upper side edge of the deflector net top pass through the upper edge of the deflector net and the top of the cage so that the ball will not be propelled backward toward the person who hit the ball. In another embodiment, the deflector net is secured along its upper edge to the top wall of the cage. To prevent balls that are hit high into the deflector net from being propelled backward toward the person who hit the ball, a curved slit is provided in the upper portion of the deflector net. The curved slit curves downwardly from near the upper edge of the deflector net to form a somewhat loose flap. When golf balls hit this flap, the flap recedes and folds around the ball. The energy of the ball is absorbed by the flap, and the ball then falls substantially vertically downwardly from the flap to the floor of the cage.

A still further objective of the present invention is to provide a novel cage for receiving golf balls hit toward the cage in which the cage has upstanding side walls, an upstanding back wall, a top wall and a floor. A planar deflector member extends outwardly and downwardly from the forward side edge of the floor so that when a golf ball is hit low along the ground toward the cage, the planar deflector member deflects the golf ball into the cage instead of ricocheting the golf ball back toward the person that hit the ball. In a preferred embodiment, the deflector member has an upper surface that is covered by a layer of foamed polymeric material, with a sheet of resilient polymeric material or fabric covering the layer of foamed polymeric material.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
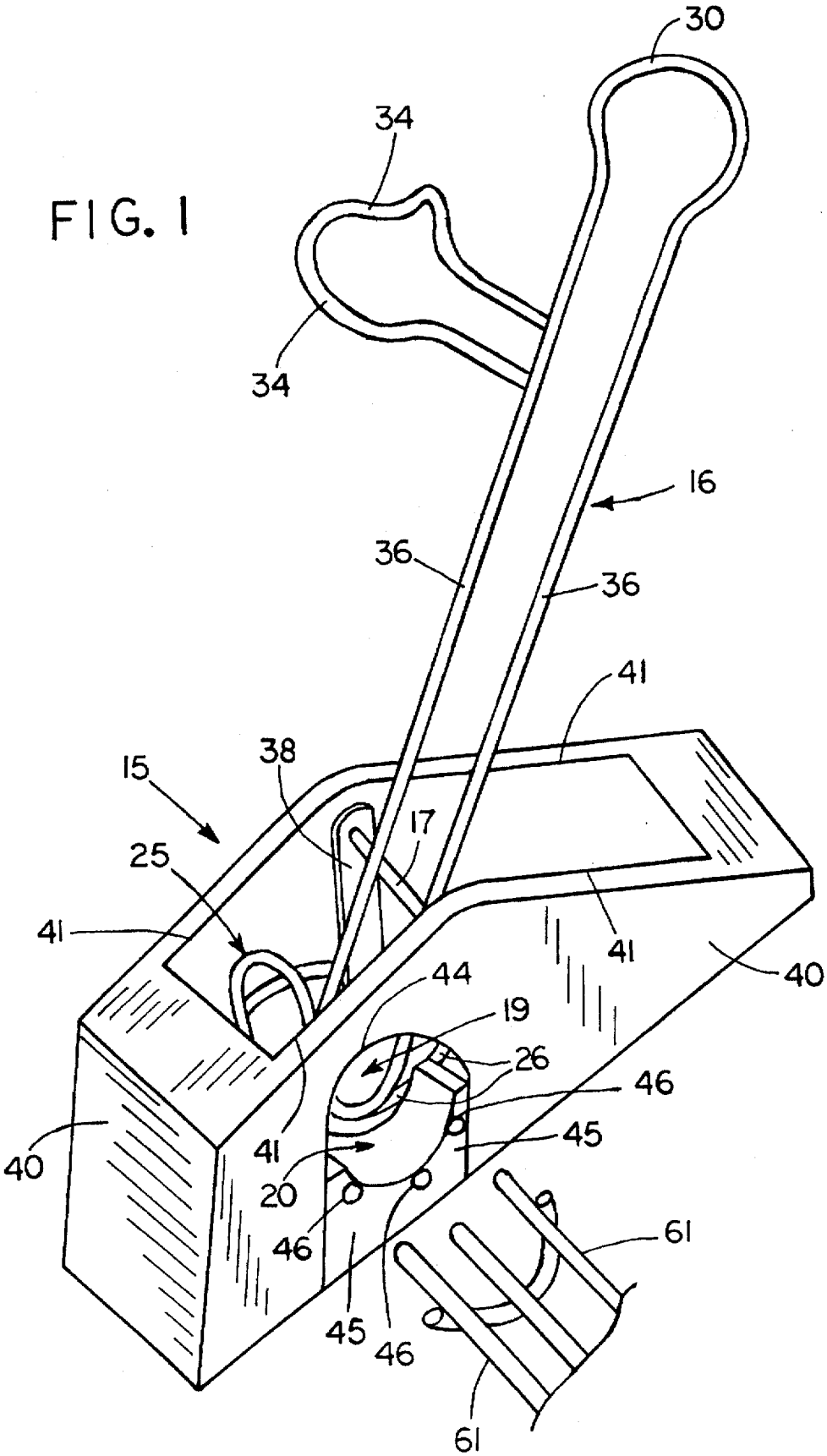
FIG. 1 is a pictorial representation of one embodiment of a device for teeing a golf ball in accordance with the present invention.
Figure 2:
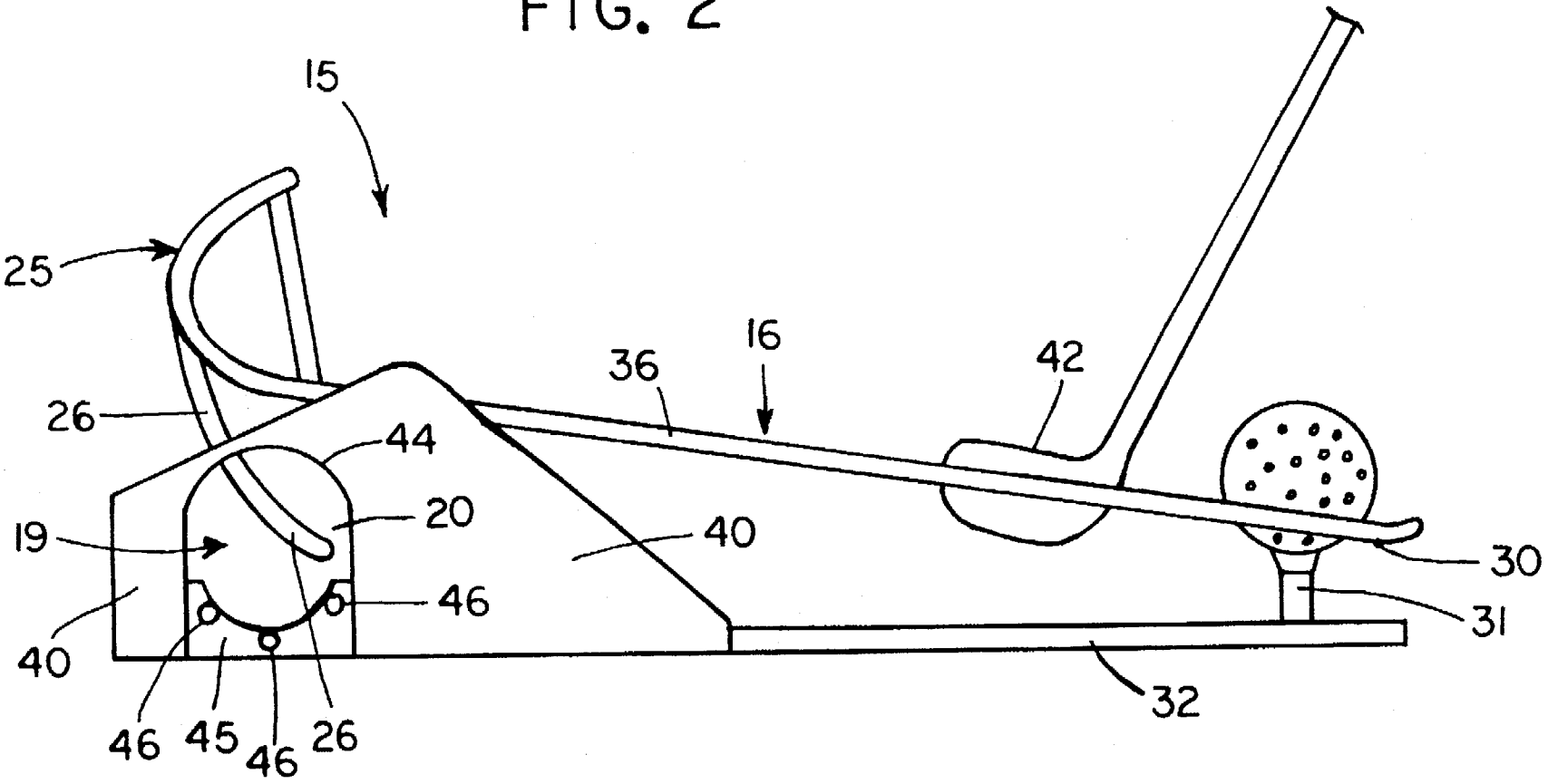
FIG. 2 is a side elevation of the device of FIG. 1 looking from the right hand side of FIG. 1.
Figure 3:
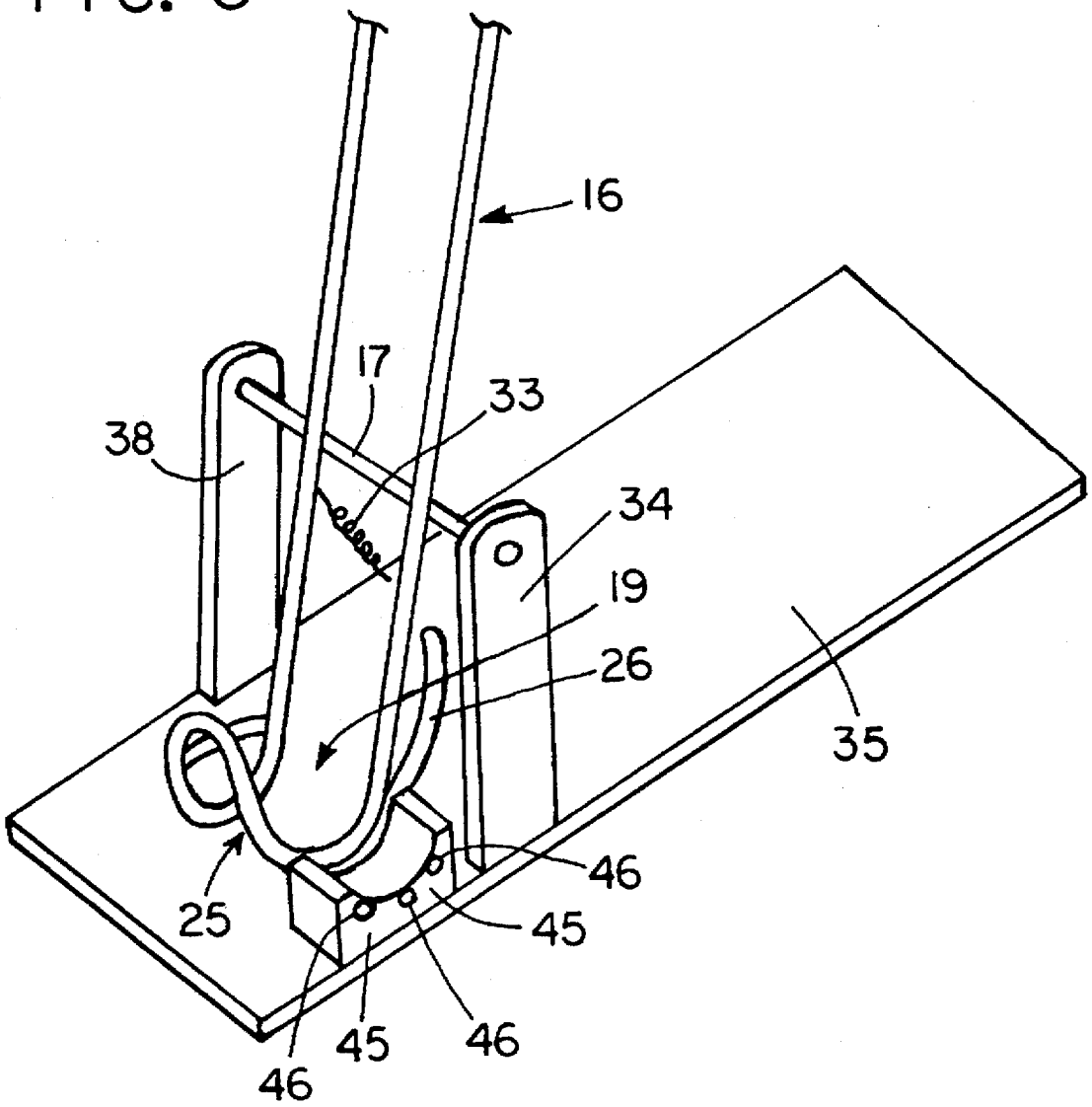
FIG. 3 is a pictorial representation of the internal parts of the device of FIG. 1.

In accordance with one aspect of the invention, a novel golf ball teeing device is provided. As shown in FIGS. 1–3, the golf ball teeing device 15 comprises an elongate trough 16 having respective proximal and distal ends. The trough 16 is capable of supporting a golf ball for rolling motion of the golf ball along the trough 16 when the trough 16 slopes downwardly from its proximal end to its distal end. Advantageously, the trough 16 comprises a pair of elongate, substantially parallel rods 36 that are spaced apart such that when the rods 36 are disposed horizontally, a golf ball can be supported by the rods 36 and when the rods 36 slope downwardly, the golf will roll down the parallel rods 36.

The trough 16 is mounted so that it pivots about a substantially horizontal pivot axis 17 that extends transversely of the trough 16 adjacent to the proximal end of the trough 16. The trough 16 pivots about the horizontal pivot axis 17 to rotate back and forth between a first position in which the trough 16 extends generally upwardly from the horizontal pivot axis 17 and a second position in which the trough 16 slants downwardly from the horizontal pivot axis 17, with the distal end of the trough 16 being slightly lower than the proximal end thereof so that a golf ball will roll down the trough 16 from the proximal end of the trough 16 to the distal end of the trough 16 when the trough 16 is in its the second position.

A ball receiving chamber 19 is located below the horizontal pivot axis 17, with the ball receiving chamber 19 being offset to one side of a vertical plane passing through the horizontal pivot axis 17. The ball receiving chamber 19 further has a ball receiving entrance 20 through which the golf ball is introduced into the ball receiving chamber 19.

A ball-cradle member 25 extends downwardly from the horizontal pivot axis 17 into the ball receiving chamber 19 when the trough 16 is in its first position, i.e., when the trough 16 extends upwardly. The ball-cradle member 25 receives and cradles a golf ball when the golf ball enters the ball receiving chamber 19 through the ball receiving entrance 20.

The ball-cradle member 25 is associated with the trough 16 such that the ball-cradle member 25 rotates upwardly about the horizontal pivot axis 17 when the trough 16 rotates downwardly from its upwardly extending, first position to its second position in which it slants downwardly. When the trough 16 rotates to its downwardly slanting, second position, the ball-cradle member 25 rotates sufficiently upward so that the golf ball cradled in the ball-cradle member 25 will roll from the ball-cradle member 25 to the proximal end of the trough 16, with the golf ball then rolling down the trough 16 to the distal end of the trough 16.

Gate means are associated with the ball receiving entrance 20, with the gate means being adapted to block the ball receiving entrance 20 when the ball-cradle member 25 rotates upwardly. The gate means prevents a subsequent golf ball from entering the ball receiving chamber 19 through the ball receiving entrance 20 until the ball-cradle member 25 rotates back downwardly into the ball receiving chamber 19. In the embodiment illustrated in FIGS. 1–3, the gate means comprises an elongate, gate member 26 that extends in a trailing direction from the ball-cradle member 25 such that as the ball cradle member 25 rotates upwardly, the elongate, gate member 26 blocks the ball receiving entrance 20 to the ball receiving chamber 19.

A circular guide loop 30 is formed at the distal end of the trough 16. The guide loop 30 has a diameter that will allow a golf ball to pass through the loop 30. The distal end of the loop 30 is preferably bent slightly upwardly with respect to the golf ball so that upwardly bent portion of the loop 30 prevents the ball from rolling over the distal end of the loop 30 and the ball must pass through the loop 30. When the golf ball rolls down the trough 16, it is stopped by the guide loop 30, with the guide loop 30 setting the ball on a suitable support member that is positioned immediately beneath the guide loop 30. Once the ball has been set on the support, the guide loop 30 can move upwardly around the golf ball so that the trough 16 can move back to its upwardly extending, first position while leaving the golf ball setting on the support.

As illustrated in FIG. 2, the support member is an upstanding tee 31 having an upper end for the golf ball to be set on. Advantageously, the tee 31 is made of a rubber like material and molded into a mat 32 that is placed by the forward end of the teeing device. The mat 32 is positioned so that when the trough 16 moves to its downwardly slanting, second position, the upper end of the tee 31 is oriented in substantially concentric alignment with the guide loop 31 at the distal end of the trough 16. Alternatively, the mat 32 could be a substantially level platform that does not have a tee. In the latter embodiment, a golf ball would be placed directly on the mat 32 from which the golf ball can be hit. In its most rudimentary form, the support member for the ball is a substantially level area of ground from which the golf ball can be hit.

The back and forth movement of the trough 16 is accomplished by the user of the device manually moving the trough downwardly to its second position, with a spring 33 being associated with the trough 16 for returning the trough to its upwardly extending, first position when the user releases the trough 16. To accommodate the manual movement of the trough 16, it is advantageous to provide a cup-like (receiver means 34) that is attached to the trough 16 somewhere generally between the mid-point of the longitudinal length of the trough 16 and the distal end of the trough 16. The cup-like receiver means 34 is adapted to be engaged by a head of a golf club to swing the trough 16 into its downwardly slanting, second position. The spring 33 as illustrated is attached to the trough 16 at a position between the pivot axis 17 and the proximal end of the trough 16. The other end of the spring 33 is attached to a flat floor member 35 of the teeing device so that the spring biases the trough to move to its upwardly extending, first position. It should be recognized that many other ways of incorporating a spring bias member into the device in place of the coil spring 33 shown in the drawings is well within the skill of the art.

In the embodiment of the teeing device shown in FIGS. 1–3, the pivot axis 17 consists of an elongate pin that is supported at its two ends (by support posts 38) that extend upwardly from a generally flat floor member 35. The opposite ends of the pin forming the pivot axis 17 are received longitudinally in openings, with the openings forming journal bearing supports in the support post 38 so that the pivot axis 17 can rotate about its longitudinal axis.

The trough 16 is advantageously formed by two elongate, substantially straight rods 36 that are firmly attached to the pivot axis 17 and extend outwardly in parallel configuration from the pivot axis 17. The proximal ends of the rods 36, i.e., the ends closest to the pivot axis 17, extend slightly from the pivot axis in a direction substantially perpendicular to the pivot axis 17. The distal ends of the rods 36 extend from the pivot axis 17 in longitudinal alignment with and in opposite direction to the proximal end portions of the rods 36. The proximal ends of the rods 36 extend only a relatively short distance from the pivot axis 17, whereas the distal ends of the rods 36 extend a substantial distance, such as from about 6 inches to 12 inches or more, from the pivot axis 17. The parallel rods 36 are spaced from each other such that when the rods 36 are in a horizontal position, a golf ball can be supported in the space between the rods 36, and when the rods 36 slant downwardly, the golf ball can roll freely down the rods 36 without falling from the rods 36.

In the embodiment of the teeing device as illustrated in FIGS. 1–3, the ball-cradle member 25 comprises a J-shaped member that has a U-shaped bottom that receives and cradles a golf ball when the golf ball enters the ball receiving chamber 10 through the ball receiving entrance 20. The J-shaped, ball cradle member 25 is advantageously formed by bending the two proximal ends of the rods 36 of the trough 16 into a smooth curve and joining the ends together. The joined ends of the rods 36 are then bent back upon the portion of the parallel rods 36 that form the proximal end of the trough 16. This forms a J-shaped cradle at the proximal ends of the trough 16 which can rotate downwardly into the ball receiving chamber 19. When the trough 16 moves to its upwardly extending, first position, the J-shaped ball-cradle member 25 is received in the ball receiving chamber 19 so that an open side of the J-shaped ball-cradle member 25 is in alignment with the ball receiving entrance 20 of the ball receiving chamber 19.

In the embodiment of the ball teeing device illustrated in FIGS. 1–3, a housing 40 is provided that encloses the major portions of the working parts of the teeing device. An elongate opening 41 is provided in the upper surface of the housing 40, and the trough 16 extends through this opening 41. The trough 16 can rotate back and forth in the opening 41. To move the trough 16 downwardly, a head of a (golf club 43) (FIG. 2) is placed in the cup member 34 (the cup member 34 being shown in FIG. 1) that is attached to the trough 16, and (the golf club 42) is used to move the trough 16 downwardly to its lowered position, i.e., its second position. The cup member 34 is advantageously made of a rod that is shaped into a circular shape, with the two ends of the rod being attached, such as by welding, to one of the rods 36 of the trough 16.

In the embodiment of the ball teeing device illustrated in FIGS. 1–3, the upstanding walls of the housing 40 form the effective sidewalls of the ball receiving chamber 19. The ball receiving entrance 20 is formed by an opening 44 in the sidewall of the housing 40. The opening 44 is in alignment with the open side of the J-shaped ball cradle member 25 when the trough 16 is in its upwardly extending, first position.

A transfer block 45 is conveniently positioned between the opening 44 in the housing 40 and the open side of the J-shaped ball cradle member 25. The transfer block 45 has a cylindrically-shaped upper surface that cradles a golf ball and allows the golf ball to roll along the cylindrical-shaped surface on its way to the open side of the J-shaped ball cradle member 25. The transfer block 45 is also adapted to receive various tracks, tubes and other means that can be used to feed golf balls to the opening 44 in the housing 40.

Figure 4:
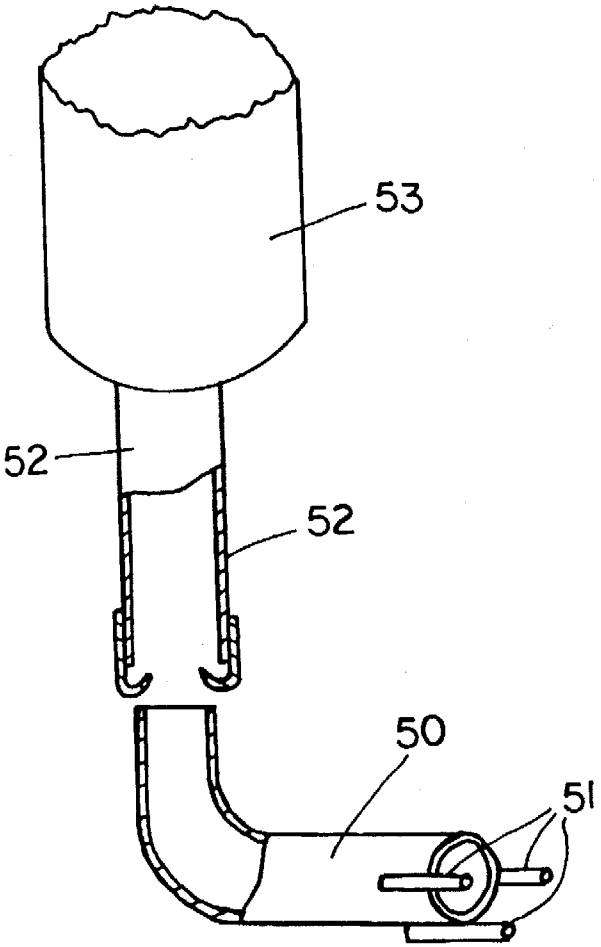
FIG. 4 is a pictorial representation of a ball tube that can be used to attach a shag bag to the device of FIG. 1.

A curved ball transfer tube 50 is shown in FIG. 4 through which golf balls can pass. The ball transfer tube 50 is adapted to direct a line of balls to the ball receiving entrance 20 formed by the opening 44 in the sidewall of the housing 40 of the teeing device 15. The ball transfer tube 50 has an open trailing end through which a golf ball can exit the ball transfer tube 50. The trailing end of the ball transfer tube 50 is attached to the teeing device 15 so that the trailing end of the ball transfer tube 50 is in alignment with and adjacent to the ball receiving entrance 20 formed by the opening 44 in the sidewall of the housing 40 of the teeing device 15. Golf balls can pass through the ball transfer tube 50 and out of the trailing end of the ball transfer tube 50 to the ball receiving entrance 20 of the teeing device. The trailing end of the ball transfer tube 50 has three spaced, rod-like, projections 51 extending therefrom. There are a cooperating set of three spaced, cylindrical openings 46 in the transfer block 45 of the teeing device 15. The projections 51 fit snugly within the openings 46 to hold the ball transfer tube 50 firmly in place on the teeing device 15.

The ball transfer tube 50 has a leading end that extends generally vertically upwardly. The leading end of the ball transfer tube 50 can be filled with golf balls to be fed sequentially to the teeing device 15, or in a particularly preferred embodiment, the leading end of the ball transfer tube 50 has an external diameter such that the leading end can be received within a ball collector tube 52 of a shag bag 53 so as to expand a constriction in the ball entry opening of the collector tube 52 of the shag bag 53. Golf balls in the shag bag 53 are fed by gravity one after another to the leading end of the ball transfer tube 50 to be in turn fed to the teeing device 15.

Figure 5:
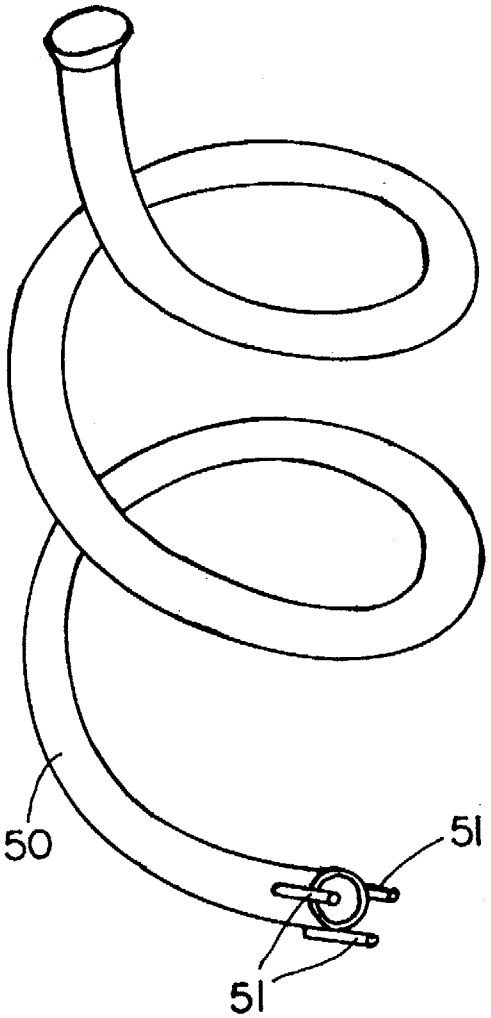
FIG. 5 is a pictorial representation of a spiral tube that can be used to deliver golf balls to the device of FIG. 1.

As mentioned previously, the ball transfer tube 50 can have a leading end that extends generally vertically upwardly, with the leading end of the ball transfer tube 50 being capable of accepting golf balls thereinto so that the golf balls are aligned in the tube 50 and can move downwardly in the tube 50 toward the open trailing end of the tube 50. A preferred embodiment of such a tube 50 is shown in FIG. 5 wherein the leading end of the ball transfer tube 50 extends upwardly in a spiral curve. The spiral curve can be filled with a large number of golf balls which can be fed in succession to the teeing device 15.

Figure 6:
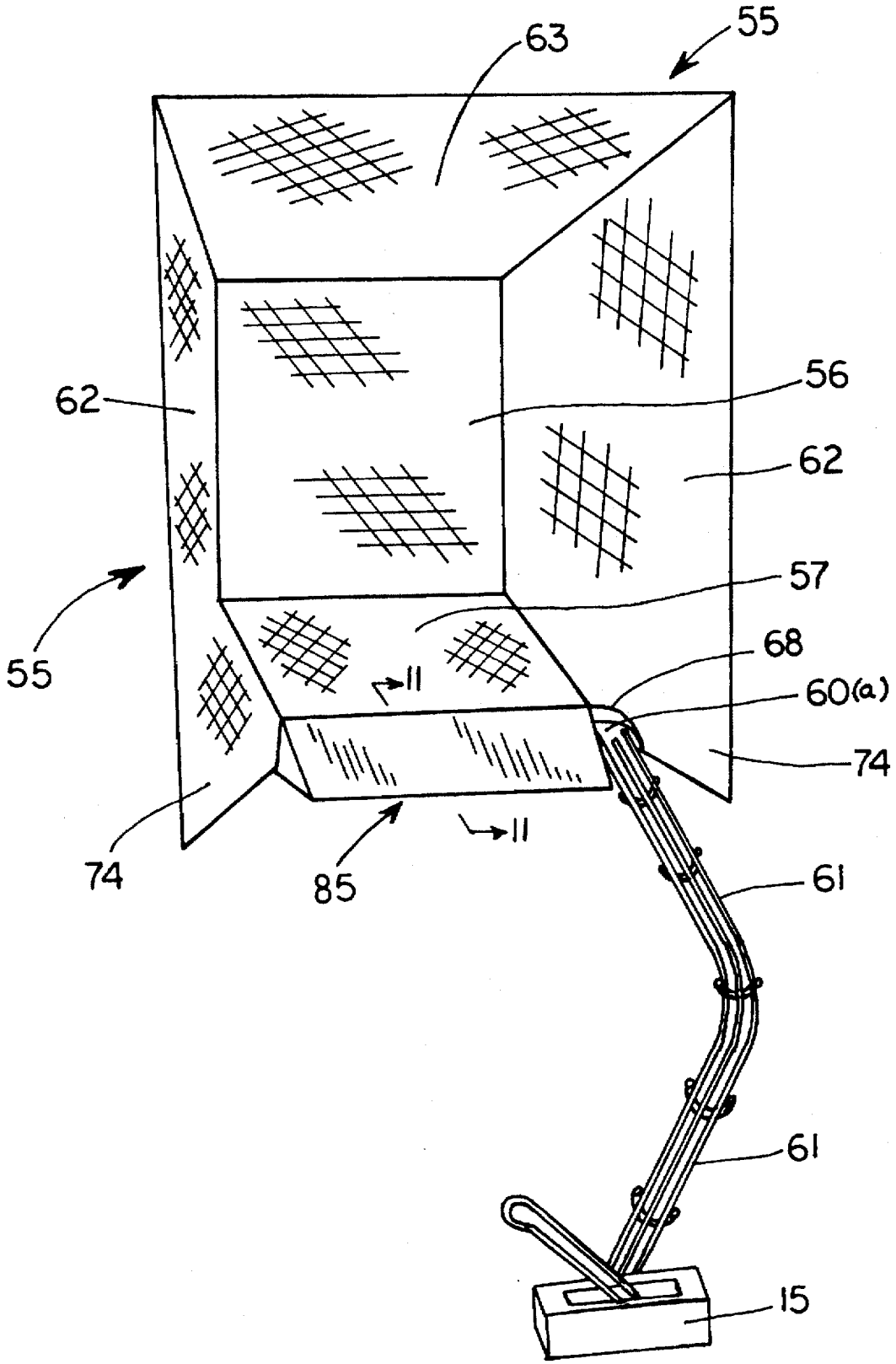
FIG. 6 is a pictorial representation of a cage and ball return track that can be used with the device of FIG. 1, with the device of FIG. 1 being shown in FIG. 6 in rudimentary, block form.

The ball teeing device 15 as previously described is advantageously used in combination with a novel cage that catches golf balls hit from the teeing device. The novel cage has means for returning the golf balls hit thereinto back to the teeing device where the balls can be re-teed and hit again and again. As illustrated in FIG. 6, the cage 55 is spaced in front of the golf ball teeing device 15, and the cage 55 is adapted to catch a golf ball when the golf ball is hit from the teeing device 15 toward the cage 55.

As illustrated in FIG. 6, the cage comprises an upstanding back wall 56 that is formed of a flexible material, such as vinyl sheeting, other plastic sheets, net material and woven and non-woven fabrics. A floor 57 is attached to the back wall 56 and extends forwardly from the back wall 56. A ball return device 60 is attached to the floor 57, with the floor 57 slanting downwardly in a direction toward the ball return device 60 so that a golf ball enters the ball return device 60 when the ball rolls downwardly on the floor 57. A ball return track 61 is attached to the ball return device 60, with the ball return track 61 having a distal end that abuts the ball receiving entrance 20 of the teeing device 15 so that the golf ball will roll from the ball return device 60 to the teeing device 15.

A particularly preferred embodiment of a novel cage 55 in accordance with the present invention is illustrated in FIGS. 6–10. In the illustrated embodiment, the cage 55 comprises, in addition to the back wall 56 and floor 57, two upstanding side walls 62 that extend forwardly from opposite, respective upstanding side edges of the back wall 56. Like the back wall 56, the side walls 62 are formed of a flexible sheet material. A top wall 63 extends forwardly from an upper edge of the back wall 56, with the opposite side edges of the top wall 63 being attached to respective upper edges of the side walls 62. Like the other walls, the top wall 63 is formed of a flexible sheet material.

The floor 57 has its back side edge attached to the back wall 56, with the floor 57 slanting from its back side edge toward a forward, lower corner of one of the side walls 62. In the illustrated embodiment, the floor 57 slants toward the right side wall 62 when looking at the cage 55 from the front of the cage 55. When a golf ball is hit into the cage 55, the ball will roll along the floor 57 toward the forward, lower corner of the right side wall 62.

Figure 7:
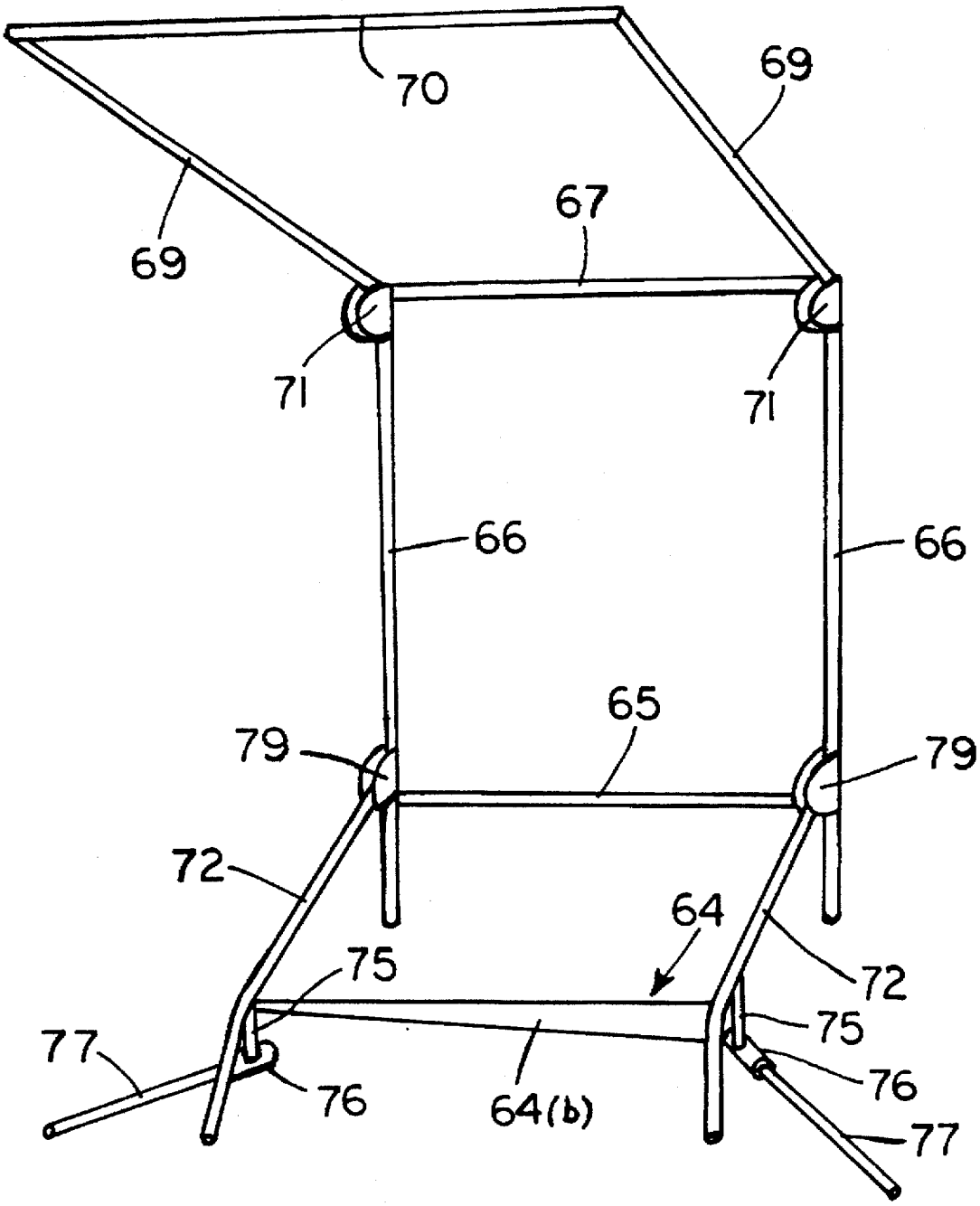
FIG. 7 is a pictorial representation of the superstructure of the cage shown in FIG. 6.

FIG. 7 shows the superstructure of the cage 55 with the side walls 62, back wall 56 top wall 63 and floor 57 removed. The superstructure comprises a pair of upstanding, elongate support members 66. A top elongate member 67 extends between the top ends of the upstanding members 66. A pair of elongate, top, side members 69 extend forwardly and slightly upwardly from the top ends of the upstanding members 66, and an elongate distal top member 70 extends from the distal, otherwise free ends of the top side members 67.

A bottom elongate member 65 extends between the upstanding members 66, with the bottom member 65 being spaced upwardly by several inches (preferably from about 5 or 6 inches to about 10 or 12 inches, or more) from the lower ends of the (upstanding members 66). The top wall 63 (as shown in FIG. 6) is attached along its perimeter edges to the rectangular superstructure formed by the distal top member 70, the top side members 69 and the top member 67. The back wall 56 (as shown in FIG. 6) is attached along its perimeter edges to the rectangular superstructure formed by the top member 69, the upstanding members 66 and the bottom member 65.

The top side members 69 are connected to the top ends of the upstanding members 66 by brackets 71 that allow the top side members 69 to be folded down along the upstanding support members 66. This allows the top wall 63 to be folded down alongside the back wall 56 when the cage 55 is to be stored.

Elongate, lower, side support members 72 extend forwardly from the upstanding members 66 The distal end portions of the side support members 72 bend downwardly to form forward end feet that are supported on the same ground support as are the lower ends of the upstanding members 66. The proximal ends of the lower support members 72 are attached to the upstanding members 66 adjacent to or at the respective points of connection between the bottom member 65 and the upstanding members 66. A tray 64, whose construction will be discussed more fully hereinafter extends from a point near the bend in one side member 72 to the corresponding point near the bend in the other side member 72.

The side walls 62 shown in FIG. 6 hang downwardly from the top side members 69 of the cage 15 and are attached near their bottom sides edges to the lower, side support members 72. The floor 57 of the cage 55 is shown in FIG. 6. The floor 57 can be made of a molded, plastic material if so desired, or is more preferably made of a flexible sheet material the same as the top wall 63, the back wall 56 and sidewalls 62. When the floor 57 is made of a flexible sheet material, it is supported from its opposite side edges from the bottom side edges of the side walls 62. The back side edge of the floor is then attached to the lower side edge of the back wall 56. The floor 57 slants downwardly from the back wall 56 toward the front of the cage 50 as well as slanting downwardly from the left side of the cage 55 toward the front corner of the side wall 62 at the right side of the cage 55. The forward side edge of the floor 57 is attached to the tray 64, and as will be discussed more fully hereinafter, the tray 64 slants from the left side of the cage 55 to the right side of the cage 55.

The side walls 62 of the cage 55 are each advantageously provided with a triangular-shaped extension 74 that turns outwardly from the forward upstanding side of each side wall 62. The extension 74 is preferably a simple continuation of the fabric of which the side walls 62 are made, so that the extensions 74 form flaps that extend outwardly from the bottom corners of the walls 62.

Figure 9:
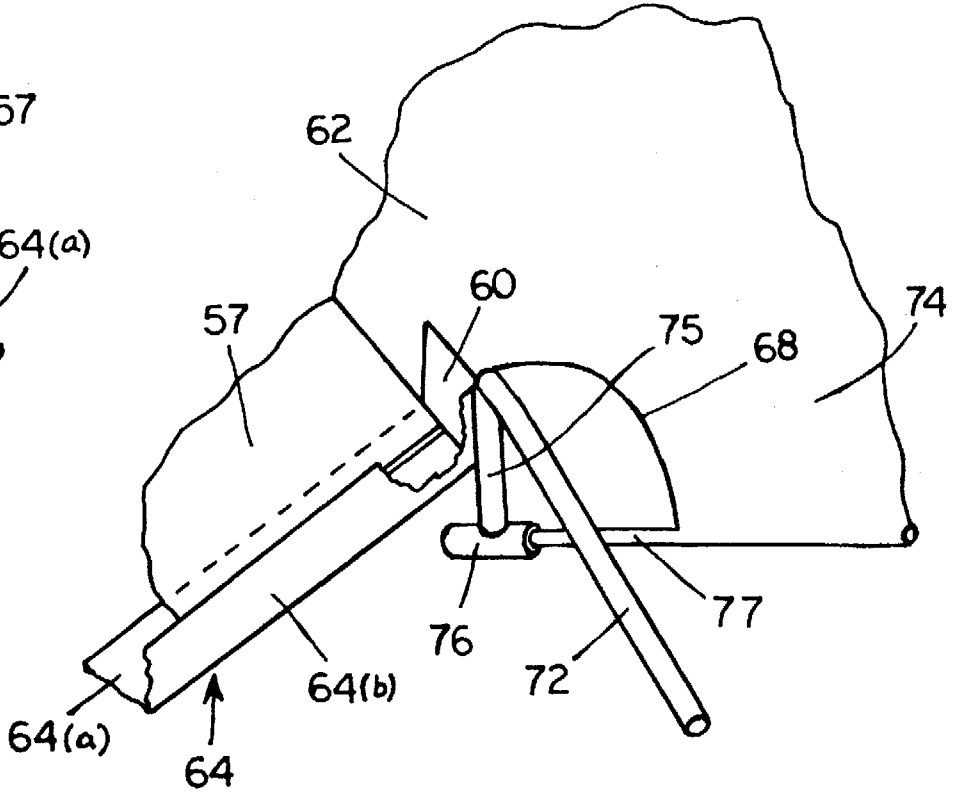
FIG. 9 is a partial pictorial representation of the lower left hand corner of the cage of FIG. 6.
Figure 10:
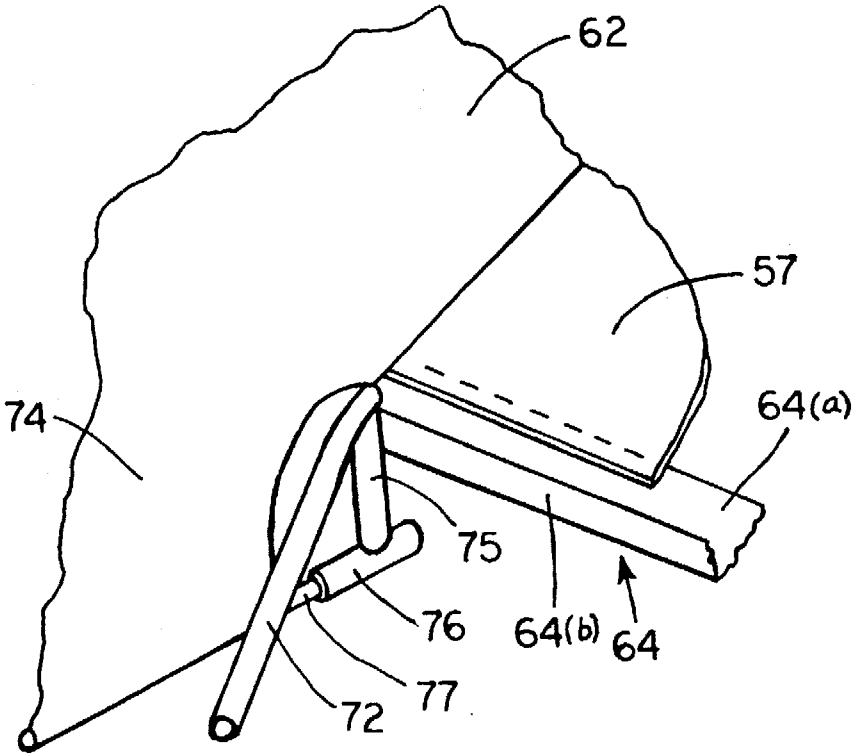
FIG. 10 is a partial pictorial representation of the lower right hand corner of the cage of FIG. 6.
Figure 11:
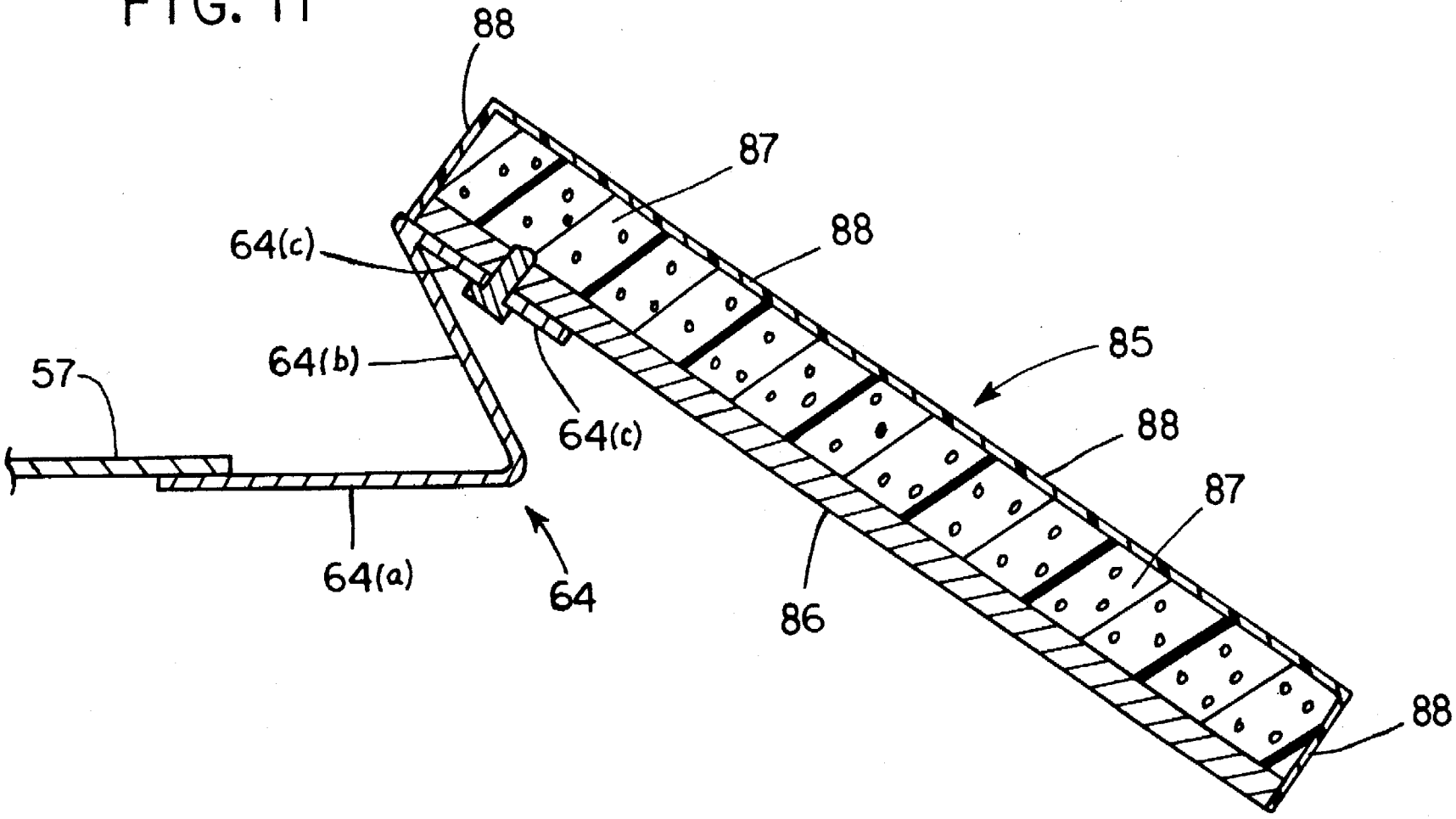
FIG. 11 is a cross section taken along line 11—11 of FIG. 6.

The extensions 74 are supported by structure as shown in FIGS. 7, 9 and 10. A vertically disposed support member 75 extends downwardly from each of the lower support members 72. The support members 75 are attached to the lower support members 72 at a point adjacent to the bend in the lower support members 72. A short tubular member 76 is attached to the downwardly extending, distal end of each of the support members 75, with the cylindrical axis of the tubular members 76 slanting forwardly and outwardly from the cage 55. Elongate rods 77 are telescopically received in the tubular members 76. The bottom edges of the extension flaps 74 are secured to the elongate rods 77.

When the cage 55 is to stored, the elongate rods 77 are removed from the tubular members 76, and the lower side support members 72 are folded back against the support members 66 of the back wall so that the floor 57 of the cage 55 folds essentially back alongside the back wall 56 of the cage 55. The support members 72 are connected to the upstanding members 62 by brackets 79 that allow the support members 72 to pivot about their ends that are connected to the upstanding members 62.

As mentioned previously, the forward end edge of the floor 57 is defined by a tray 64 that extends from one side wall 62 of the cage 55 to the other side wall 62. As best shown in FIG. 10, the tray 64 comprises a substantially horizontally disposed, elongate, relatively narrow, bottom plate 64(*a*). The tray 64 further has an upstanding elongate, relatively narrow, side plate 64(*b*) that extends upwardly from the bottom plate 64(*a*). Advantageously, the side plate 64(*b*) is formed by simply bending a flat piece of sheet material, such as sheet metal, to form the side plate 64(*b*) extending upwardly from the flat bottom plate 64(*a*) portion of the plate 64(*a*). The side plate 64(*b*) bends slightly back upon the bottom plate 64(*a*) so that the side plate 64(*b*) slants back toward the inside of the cage 55. A top plate 64(*c*) is formed by bending the distal side edge portion of the side plate 64(*b*) back upon itself so that the top plate 64(*c*) extends outwardly and downwardly.

The forward end edge of the flexible sheet material forming the floor 57 is attached to the backwardly extending side edge of the bottom plate 64(*a*) of the tray 64. This allows a golf ball to roll onto the bottom plate 64(*a*) of the tray 64 and then roll freely along the bottom plate 64(*a*) to the lower end of the tray 64. The bottom plate 64(*a*) slants from one side wall 62 of the cage 55 toward the other side wall 62. As illustrated in FIGS. 7, 9 and 10, the depth of the upstanding side plate 64(*b*) increases in the direction of the right hand side wall 62 of the cage 55. Near the corner of the left hand side wall 62, as shown in FIG. 10, the side plate 64(*b*) has a relatively shallow or short depth. As shown in FIG. 9, the depth of the side plate 64(*b*) has significantly increased at the right hand side of the cage 55. The opposite sides of the tray 64 are attached to the extension supports 75 so that the upper edges of the side plate 64(*b*) at the respective ends thereof are positioned at the junction of the respective extension supports 75 and the lower side support members 72 of the cage 55. By increasing the depth of the side plate 64(*b*), the bottom plate 64(*a*) is made to slant downwardly in a direction toward the right hand side of the cage 55 as illustrated. The tray 64 with its upstanding wall 64(*b*) and its bottom plate 64(*a*) prevents a golf ball from rolling over the forward side edge of the floor 57, and instead directs the golf ball toward the ball return feature of the cage 55.

As mentioned previously, the golf ball, when hit into the cage 55 rolls along the floor 57 to a ball return device 60 that is located at the lowest point of the floor 57. As illustrated in FIG. 9, the ball return device 60 can in its simplest form be an opening in the side wall 62 that allows a golf ball to roll onto a ball return track 61. The ball return track 61 can then direct the ball to roll under the action of gravity back to the teeing device 15. In such an embodiment, the opening in the side wall 62 forming the ball return device 60 must be at a higher elevation than the teeing device 15 so that the ball will roll down the track 61 to the teeing device 15.

In a preferred embodiment of the invention, the floor 57 of the cage 55 is not elevated or at least not elevated sufficiently so that the ball will roll along the track 61 by the action of gravity. When the floor 57 is not of sufficient elevation to allow the golf ball to roll by gravity along the track 61, it is advantageous to provide a kick back device 60(*a*) (FIGS. 6, 8, 12 and 13) as part of the ball return device 60. The kick back device 60(*a*) projects the golf ball along the ball return track 61 and ultimately back to the teeing device 15.

Figure 8:
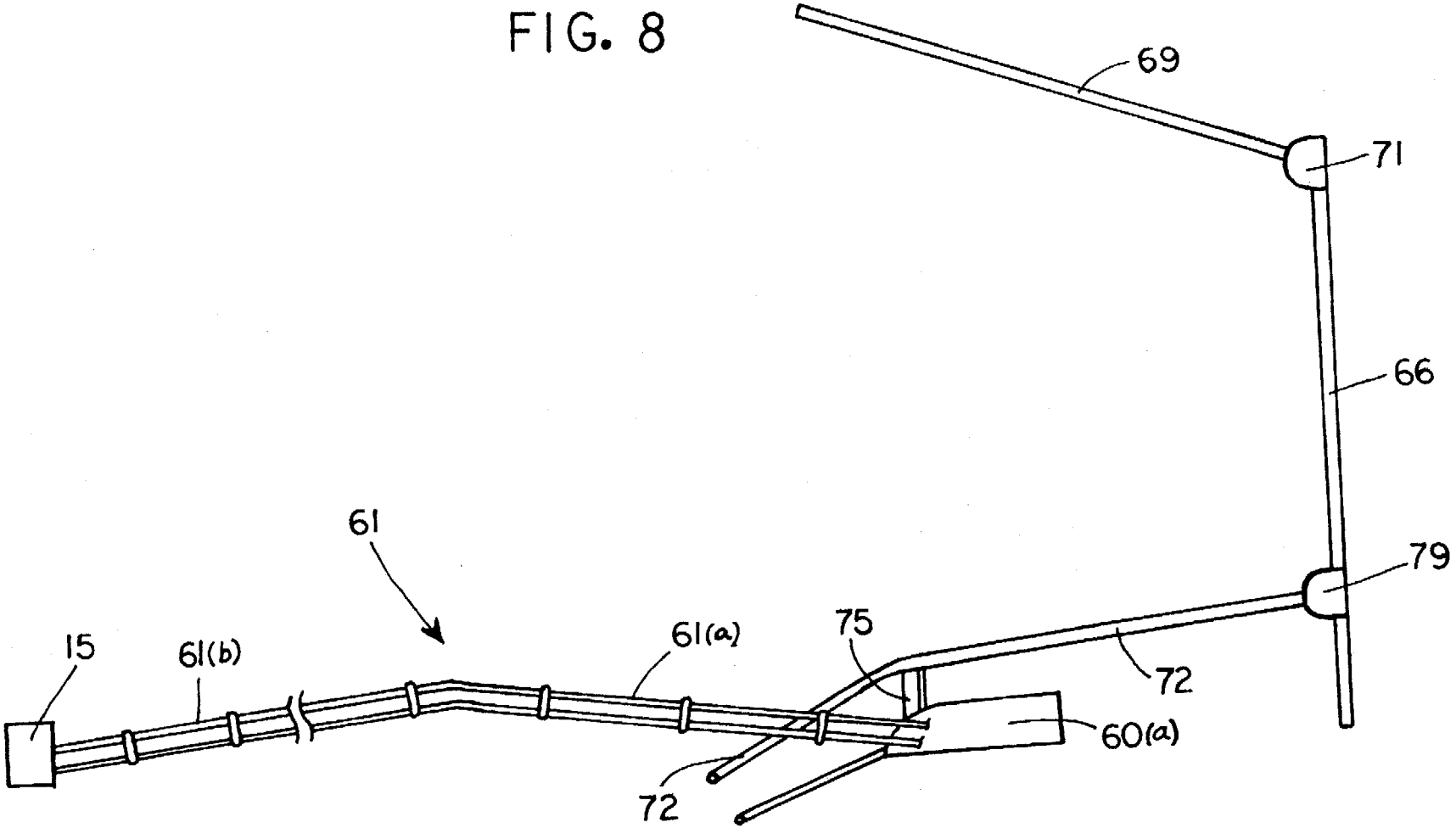
FIG. 8 is a side view of the superstructure of FIG. 7 taken from the right hand side of FIG. 7 and showing a kick back ball return device and a ball return track attached to the side of the superstructure.

As shown in FIG. 8, the kick back device 60(*a*) is located adjacent to the support member 75 and the side support member 72. The kick back device 60(*a*) is thus also positioned along side and adjacent to the opening that forms the ball return device 60 in the side wall 62 of the cage 55. A ball rolling down the tray 64 will roll into the kick back device 60(*a*). The kick back device 60(*a*) is a conventional device used to return golf balls in commercially available golf putting apparatus. The kick back device 60(*a*) has the ability to impel a golf ball in a desired direction. The kick back device 60(*a*) is well known in the art and will not be further described herein.

In the preferred embodiment illustrated in FIG. 8, the ball return track 61 has a first portion 61(*a*) and a second portion 61(*b*) that are connected in series. The first portion 61(*a*) extends from the kick back device 60(*a*) and slants upwardly so that the distal end of the first portion 61(*a*) is at an elevation slightly higher than the ball receiving entrance 20 of the teeing device 15. The second portion 61(*b*) extends from the distal end of the first portion 61(*a*) to the ball receiving entrance 20 of the teeing device 15. A golf ball that rolls into the kick back device 60(*a*) from the floor 57 of the cage 55 is propelled up the first portion 61(*a*) of the ball return track 61 by the kick back device 60(*a*). The ball then rolls down the second portion 61(*b*) of the ball return track 61 to the teeing device 15 under the action of gravity.

The ball return track 61 is conveniently made of three parallel elongate rods that are spaced from each other in a curved, trough-like orientation so that the golf balls will roll smoothly in and along the track 61 The three rods at the distal end of the track 61 are made to be readily inserted into the receiver openings 46 in the transfer block 45 at the ball receiving entrance 20 of the teeing device 15. It should be understood, that the ball return track could be made of various materials and designs that differ from the three parallel rods as illustrated. For instance, the track could be molded from a polymeric material in the shape of a trough, or the track could be a cylindrical tube made of metal or polymeric material.

The ball return track 61 extends from the kick back device 60(*a*) through an opening 68 that is formed in the side wall 62 of the cage. The kick back device 60(*a*) is advantageously made to be removably attached to the cage 55 so that when the cage 55 is folded for storage purposes, the kick back device 60(*a*) is readily removed to accommodate the folding of the cage 55. Alternatively, of course, the kick back device 60(*a*) can be attached permanently to the cage 55. The ball return track 61 is also advantageously made to be removably attached to the kick back device 60(*a*) when the kick back device is included as part of the ball return device 60. If the ball return device 60 does not include a kick back device, then the ball return track 61 is advantageously made to be removably attached to the side of the cage 55 adjacent to the ball return device 60. The other end of the ball return track 61 is made to be removably connected to the teeing device 15.

The cage 55 of the present invention further includes a planar deflector member 85 that extends from the upstanding wall 64(*a*) of the tray 64. As best shown in FIG. 10, the deflector member 85 extends outwardly and downwardly from the top of the upstanding wall 64(*b*) of the tray 64 so that when a golf ball is hit low along the ground toward the cage 55, the planar deflector member 85 will deflect the golf ball into the cage 15 instead of ricocheting the golf ball back toward the person that hit the golf ball. In the preferred embodiment as illustrated, the deflector member 85 comprises a backing board 86 that is attached to the top plate 64(*c*) of the tray 64. The upper surface of the backing board 86 is covered by a layer 87 of foamed polymeric material, with a sheet 88 of material, such as vinyl, covering the layer 87 of foamed polymeric material.

Figure 12:
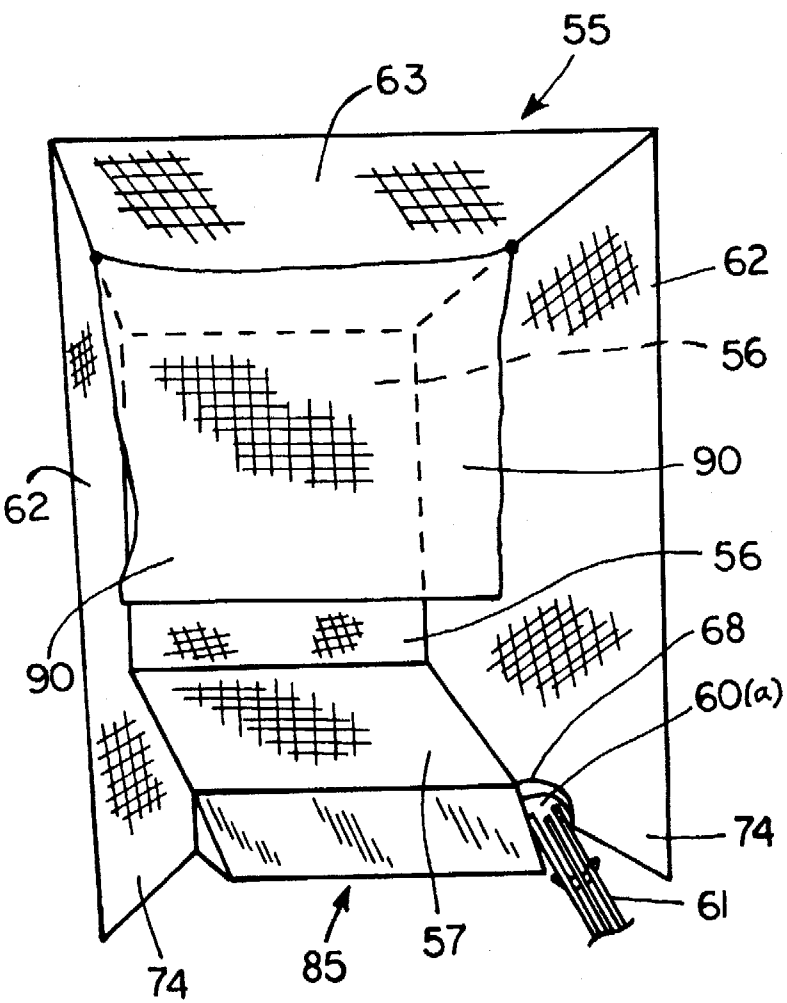
FIG. 12 is a pictorial representation of an embodiment of the cage of the present invention in which a deflector sheet hangs from opposite corners formed by the sides and top of the cage.

In a preferred embodiment of the cage 55 of the present invention, the cage 55 further includes a deflector sheet 90, as shown in FIG. 12 of the drawings. The deflector sheet 90 is hung from one side wall 62 of the cage 55 to the other side wall 62 and is spaced from the back wall 56 of the cage 55 by a distance from about one foot to three feet. The deflector sheet 90 is secured at its upper corners to the upper side edges of the respective side walls 62 of the cage 55. This leaves a relatively narrow space between the upper side edge of the deflector sheet 90 and the top wall 63 of the cage 55. When a ball is hit high into the cage 55 so as to initially hit the top wall 63 or the top portion of the deflector sheet 90, the ball will ricochet through the narrow space between the top wall 63 and the top edge of the deflector sheet 90 and be trapped behind the deflector sheet 90 rather than ricochet back toward the person who hit the ball.

Figure 13:
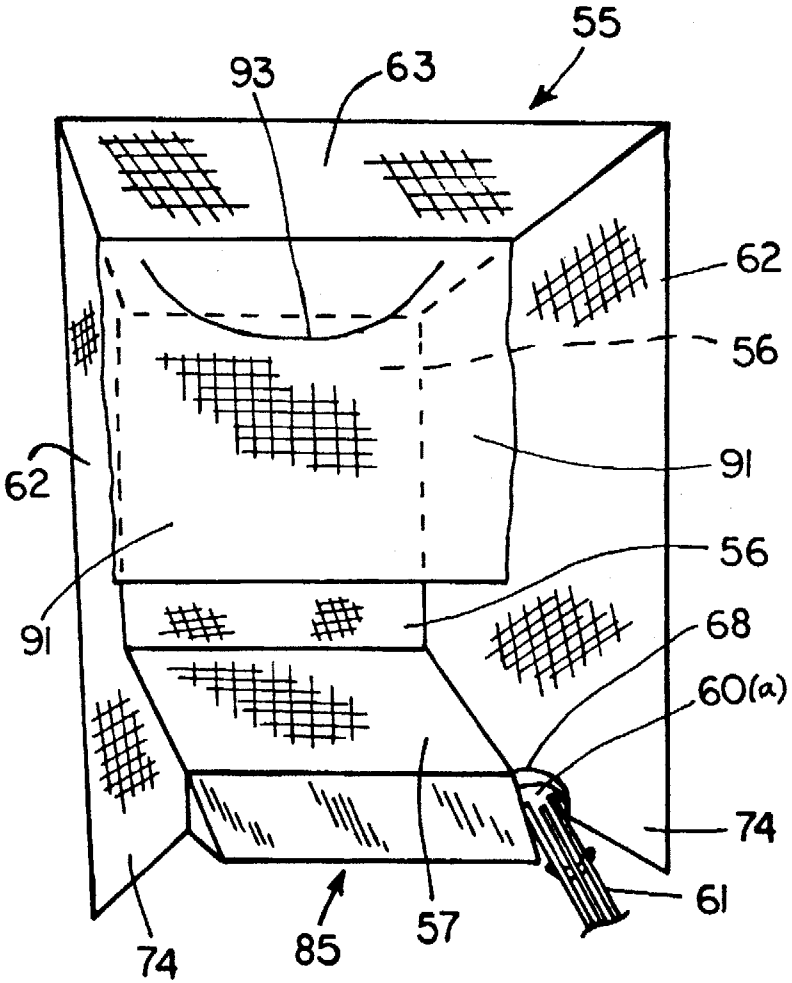
FIG. 13 is a pictorial representation of a modified version of the cage of FIG. 12, wherein the deflector sheet hangs from the top side of the cage.

In a similar embodiment to that of the above paragraph, the cage 55 includes a deflector sheet 91, as shown in Fig. 13 of the drawings. The deflector sheet 91 is hung from one side wall 62 of the cage 55 to the other side wall 62 and is spaced from the back wall 56 of the cage 55 by a distance from about one foot to three feet. The deflector sheet 91 is secured along its upper side edge to the top wall 63 of the cage 55. The deflector sheet 92 further has a curved slit 93 cut in the upper portion thereof. The curved slit 93 curves downwardly from near the upper edge of the deflector sheet 91. This leaves a relatively narrow space along the curved slit 93. When a ball is hit high into the cage 55 so as to initially hit the top wall 63 or the top portion of the deflector sheet 91, the ball will ricochet through the narrow space formed by the slit 93 and be trapped behind the deflector sheet 91 rather than ricochet back toward the person who hit the ball.

Although preferred embodiments of the ball teeing device and an associated cage have been illustrated and described, it is to be understood that the present disclosure is made by way of example and that various other embodiments are possible without departing from the subject matter coming within the scope of the following claims, which subject matter is regarded as the invention.

I claim:

1. A golf ball teeing device comprising an elongate trough having respective proximal and distal ends, said trough being capable of supporting a golf ball for rolling motion of the golf ball along said trough when the trough slopes downwardly from its proximal end to its distal end;

a substantially horizontal pivot axis extending transversely of said trough adjacent to said proximal end of said trough so that said trough can pivot about said horizontal pivot axis to rotate back and forth between a first position in which the trough extends generally upwardly from said horizontal pivot axis and a second position in which said trough slants downwardly from said horizontal pivot axis so that the distal end of said trough is slightly lower than the proximal end thereof so that said golf ball will roll down said trough from the proximal end of said trough to the distal end of said trough when said trough is in its said second position;

a ball receiving chamber located below said horizontal pivot axis, said ball receiving chamber being offset to the side of a vertical plane passing through said horizontal pivot axis, said ball receiving chamber further having an opening in a sidewall thereof, whereby said opening forms a ball receiving entrance through which said golf ball is introduced into said ball receiving chamber;

a ball-cradle member extending downwardly from said horizontal pivot axis into said ball receiving chamber when said trough is in its said first position, said ball-cradle member receives and cradles said golf ball when said golf ball enters said ball receiving chamber through the ball receiving entrance formed by the opening in the sidewall of said ball receiving chamber;

said ball-cradle member being associated with said trough such that the ball-cradle member rotates upwardly about said horizontal pivot axis when said trough rotates downwardly from its said first position to its said second position, whereby when said trough rotates to its said second position, the ball-cradle member rotates sufficiently upward so that said golf ball cradled therein will roll from the ball-cradle member to the proximal end of the trough, with said golf ball then rolling down said trough to the distal end thereof;

gate means associated with said ball receiving entrance, said gate means being adapted to block said ball receiving entrance when said ball-cradle member rotates upwardly, whereby a subsequent golf ball cannot enter said ball receiving chamber through said ball receiving entrance until said ball-cradle member rotates back downwardly into said ball receiving chamber;

a circular guide loop formed at the distal end of said trough, said guide loop having a diameter that will allow said golf ball to pass through the loop, whereby when said golf ball rolls down said trough and is set on a suitable support member by said guide loop, said guide loop can move upwardly around said golf ball so that said trough can move back to its said first position while leaving said golf ball setting on said support; and means for rotating said trough back and forth between its said first and second positions.

2. A golf ball teeing device in accordance with claim 1 wherein said support member is an upstanding tee having an upper end for said golf ball to be set on, with said upper end of said tee being positioned so that when said trough moves to its said second position, the upper end of said tee is in substantially concentric alignment with said guide loop at the distal end of said trough.

3. A golf ball teeing device in accordance with claim 1 wherein said support member is a substantially level platform from which said golf ball can be hit.

4. A golf ball teeing device in accordance with claim 1 wherein said support member is a substantially level area of ground from which said golf ball can be hit.

5. A golf ball teeing device in accordance with claim 1 wherein means for rotating said trough back and forth comprises a spring attached to said trough near the proximal end of said trough, said spring biasing said trough to move to its said first position; and means attached to said trough, for being engaged by a head of a golf club to swing said trough into its second position.

6. A golf ball teeing device in accordance with claim 1 wherein said trough comprises a pair of elongate, substantially parallel rods that are spaced apart such that when the rods are disposed horizontally, said golf ball can be supported by the rods and when the rods slope downwardly, the golf will roll down the parallel rods.

7. A golf ball teeing device in accordance with claim 6 wherein said ball-cradle member comprises a J-shaped member that has a U-shaped bottom that receives and cradles said golf ball when the golf ball enters said ball receiving chamber through said ball receiving entrance.

8. A golf ball teeing device in accordance with claim 1 wherein said gate means comprises an elongate, gate member extending in a trailing direction from said ball-cradle member such that as the ball cradle member rotates upwardly, the elongate, gate member blocks said ball receiving entrance to said ball receiving chamber.

9. A golf ball teeing device in accordance with claim 1 further comprising a curved ball transfer tube through which said golf ball can pass;

said ball transfer tube having an open trailing end through which said golf ball can exit said ball transfer tube, said trailing end of said ball transfer tube is attached to said teeing device so that the trailing end of said ball transfer tube is in alignment with and adjacent to said ball receiving entrance, whereby said golf ball can pass through said ball transfer tube and out of said trailing end of said ball transfer tube to said ball receiving entrance; and said ball transfer tube having a leading end that extends generally vertically upwardly, said leading end of said ball transfer tube having an external diameter such that said leading end can be received within a ball entrance of a shag bag so as to expand a constriction in the ball entrance of the shag bag, whereby golf balls in the shag bag are fed by gravity one after another to the leading end of said ball transfer tube.

10. A golf ball teeing device in accordance with claim 1 further comprising a curved ball transfer tube through which said golf ball can pass;

said ball transfer tube having an open trailing end through which said golf ball can exit said ball transfer tube, said trailing end of said ball transfer tube is attached to said teeing device so that the trailing end of said ball transfer tube is in alignment with and adjacent to said ball receiving entrance, whereby said golf ball can pass through said ball transfer tube and out of said trailing end of said golf transfer tube to said ball receiving entrance; and said ball transfer tube having a leading end that extends generally vertically upwardly, said leading end of said ball transfer tube being capable of accepting golf balls thereinto so that the golf balls are aligned in said tube and can move downwardly in said tube toward said open trailing end of said tube.

11. A golf ball teeing device in accordance with claim 10 wherein said leading end of said ball transfer tube extends upwardly in a spiral curve.

12. A golf ball teeing device comprising an elongate trough having respective proximal and distal ends, said trough being capable of supporting a golf ball for rolling motion of the golf ball along said trough when the trough slopes downwardly from its proximal end to its distal end;

a substantially horizontal pivot axis extending transversely of said trough adjacent to said proximal end of said trough so that said trough can pivot about said horizontal pivot axis to rotate back and forth between a first position in which the trough extends generally upwardly from said horizontal pivot axis and a second position in which said trough slants downwardly from said horizontal pivot axis so that the distal end of said trough is slightly lower than the proximal end thereof so that said golf ball will roll down said trough from the proximal end of said trough to the distal end of said trough when said trough is in its said second position;

a ball receiving chamber located below said horizontal pivot axis, said ball receiving chamber being offset to the side of a vertical plane passing through said horizontal pivot axis, said ball receiving chamber further having an opening in a sidewall thereof, whereby said opening forms a ball receiving entrance through which said golf ball is introduced into said ball receiving chamber;

a ball-cradle member extending downwardly from said horizontal pivot axis into said ball receiving chamber when said trough is in its said first position, said ball-cradle member receives and cradles said golf ball when said golf ball enters said ball receiving chamber through the ball receiving entrance formed by the opening in the sidewall of said ball receiving chamber;

said ball-cradle member being associated with said trough such that the ball-cradle member rotates upwardly about said horizontal pivot axis when said trough rotates downwardly from its said first position to its said second position, whereby when said trough rotates to its said second position, the ball-cradle member rotates sufficiently upward so that said golf ball cradled therein will roll from the ball-cradle member to the proximal end of the trough, with said golf ball then rolling down said trough to the distal end thereof;

gate means associated with said ball receiving entrance, said gate means being adapted to block said ball receiving entrance when said ball-cradle member rotates upwardly, whereby a subsequent golf ball cannot enter said ball receiving chamber through said ball receiving entrance until said ball-cradle member rotates back downwardly into said ball receiving chamber;

a circular guide loop formed at the distal end of said trough said guide loop having a diameter that will allow said golf ball to pass through the loop whereby when said golf ball rolls down said trough set on a suitable support member by said guide loop said guide loop can move upwardly around said golf ball so that said trough can move back to its said first position while leaving said golf ball setting on said support;

means for rotating said trough back and forth between its said first and second positions;

a cage spaced from the golf ball teeing device, said cage being adapted to catch said golf ball when said golf ball is hit from said teeing device toward said cage with a golf club, said cage comprising an upstanding back wall being formed of a flexible sheet material;

a floor attached to said back wall and extending forwardly from said back wall;

a ball return device attached to said floor, with said floor slanting downwardly in a direction toward said ball return device, so that said golf ball enters said ball return device when it rolls downwardly on said floor; and a ball return track attached to said ball return device, said ball return track having a distal end that abuts the ball receiving entrance of said teeing device so that said golf ball will roll from said ball return device to said teeing device.

13. A golf ball teeing device in accordance with claim 12 further wherein said ball return device is a kick back device that projects said golf ball along said ball return track; and said ball return track has a first portion and a second portion that are connected in series, with the first portion extending from said kick back device and slanting upwardly so that the distal end of said first portion is at an elevation slightly higher than the ball receiving entrance of said teeing device, and with the second portion extending from the distal end of said first portion to the ball receiving entrance of said teeing device, such that the golf ball is propelled up the first portion of said ball return track by said kick back device and then rolls down the second portion of said ball return track under the action of gravity.

14. A golf ball teeing device in accordance with claim 12 wherein said cage further includes a deflector sheet that is made of a flexible material and is hung from one side wall of said cage to the other side wall and is spaced from the back wall of the cage by a distance from about one foot to three feet, said deflector sheet being secured at its upper corners to the upper side edges of the respective side walls of the cage.

15. A golf ball teeing device in accordance with claim 12 wherein said cage further includes a deflector sheet that is made of a flexible material and is hung from one side wall of said cage to the other side wall and is spaced from the back wall of the cage by a distance from about one foot to three feet, said deflector sheet being secured along its upper edge to the top wall of the cage, said deflector sheet further having a curved slit in the upper portion thereof, with the curved slit curving downwardly from near said upper edge of the deflector sheet.

16. A golf ball teeing device in accordance with claim 12 wherein said cage further includes a planar deflector member that extends from the upstanding wall of said tray, said planar deflector member extending outwardly and downwardly from the top of said upstanding wall of said tray so that when said golf ball is hit low along the ground toward said cage, the planar deflector member deflects said golf ball into the cage instead of ricocheting said golf ball back toward the person that hit the golf ball.

17. A golf ball teeing device in accordance with claim 16 wherein said planar deflector member has an upper surface that is covered by a layer of foamed polymeric material, with a sheet of material covering the layer of foamed polymeric material.

18. A golf ball teeing device comprising an elongate trough having respective proximal and distal ends said trough being capable of supporting a golf ball for rolling motion of the golf ball along said trough when the trough slopes downwardly from its proximal end to its distal end;

a substantially horizontal pivot axis extending transversely of said trough adjacent to said proximal end of said trough so that said trough can pivot about said horizontal pivot axis to rotate back and forth between a first position in which the trough extends generally upwardly from said horizontal pivot axis and a second position in which said trough slants downwardly from said horizontal pivot axis so that the distal end of said trough is slightly lower than the proximal end thereof so that said golf ball will roll down said trough from the proximal end of said trough to the distal end of said trough when said trough is in its said second position;

a ball receiving chamber located below said horizontal pivot axis, said ball receiving chamber being offset to the side of a vertical plane passing through said horizontal pivot axis, said ball receiving chamber further having an opening in a sidewall thereof, whereby said opening forms a ball receiving entrance through which said golf ball is introduced into said ball receiving chamber;

a ball-cradle member extending downwardly from said horizontal pivot axis into said ball receiving chamber when said trough is in its said first position, said ball-cradle member receives and cradles said golf ball when said golf ball enters said ball receiving chamber through the ball receiving entrance formed by the opening in the sidewall of said ball receiving chamber;

said ball-cradle member being associated with said trough such that the ball-cradle member rotates upwardly about said horizontal pivot axis when said trough rotates downwardly from its said first position to its said second position, whereby when said trough rotates to its said second position, the ball-cradle member rotates sufficiently upward so that said golf ball cradled therein will roll from the ball-cradle member to the proximal end of the trough, with said golf ball then rolling down said trough to the distal end thereof;

gate means associated with said ball receiving entrance said gate means being adapted to block said ball receiving entrance when said ball-cradle member rotates upwardly, whereby a subsequent golf ball cannot enter said ball receiving chamber through said ball receiving entrance until said ball-cradle member rotates back downwardly into said ball receiving chamber;

a circular guide loop formed at the distal end of said trough, said guide loop having a diameter that will allow said golf ball to pass through the loop, whereby when said golf ball rolls down said trough and is set on a suitable support member by said guide loop, said guide loop can move upwardly around said golf ball so that said trough can move back to its said first position while leaving said golf ball setting on said support;

means for rotating said trough back and forth between its said first and second positions;

a cage spaced from the golf ball teeing device, said cage being adapted to catch said golf ball when said golf ball is hit from said teeing device toward said cage with a golf club, said cage comprising an upstanding back wall having opposite upstanding side edges and a substantially horizontal upper edge, said back wall being formed of a flexible material;

two upstanding side walls that extend forwardly from opposite, respective, upstanding side edges of said back wall, said side walls being formed of a flexible sheet material;

a top wall extending forwardly from an upper edge of said back wall, with the opposite side edges of said top wall being attached to respective upper edges of said side walls, said top wall being formed of a flexible sheet material;

a floor having its back side edge attached to said back wall, with said floor slanting from its back side edge toward a forward, lower corner of one of said side walls so that said golf ball when hit into said cage will roll along said floor toward said forward, lower corner of said one of said side walls;

an opening in the forward, lower corner of said one of said side walls through which said golf ball can pass as said golf ball rolls along said floor to said forward, lower corner of said one said side walls;

a tray that slants upwardly from said opening in said forward, lower corner of said one of said side walls to the other of said side walls, said tray forming a forward side edge of said floor, said tray having an upstanding wall extending from the forward most side edge of said tray such that the tray and its upstanding wall directs said golf ball toward said opening when said golf ball rolls forward on said floor of said cage, whereby said tray and its upstanding wall prevents said golf ball from rolling over the forward side edge of said floor;

a ball return device attached to said cage at said opening in said forward, lower corner of said one of said side walls so that said golf ball enters said ball return device when it rolls through said opening in said forward, lower end of said one of said side walls; and a ball return track attached to said ball return device, said ball return track having a distal end that abuts the ball receiving entrance of said teeing device, so that said golf ball will roll from said ball return device to said teeing device.

19. A golf ball teeing device in accordance with claim 18 further wherein said ball return device is a kick back device that projects said golf ball along said ball return track; and said ball return track has a first portion and a second portion that are connected in series, with the first portion extending from said kick back device and slanting upwardly so that the distal end of said first portion is at an elevation slightly higher than the ball receiving entrance of said teeing device, and with the second portion extending from the distal end of said first portion to the ball receiving entrance of said teeing device, such that the golf ball is propelled up the first portion of said ball return track by said kick back device and then rolls down the second portion of said ball return track under the action of gravity.

20. A golf ball teeing device in accordance with claim 19 wherein said ball return device is removably attached to said cage at a point adjacent to said opening in the lower, front end of said one of said sides of said cage; and said ball return track is removably attached at one of its ends to said ball return device and removably attached at it other end to said teeing device.

21. A golf ball teeing device in accordance with claim 19 wherein said sides and top of said cage can be folded against the back and the folded sides, top and back can be folded against the bottom such that the cage can be easily stored in the form of a generally flat, rectangular package.

22. A golf ball teeing device in accordance with claim 19 wherein said cage further includes a deflector sheet that is made of a flexible material and is hung from one side wall of said cage to the other side wall and is spaced from the back wall of the cage by a distance from about one foot to three feet, said deflector sheet being secured at its upper corners to the upper side edges of respective side walls of the cage.

23. A golf ball teeing device in accordance with claim 19 wherein said cage further includes a deflector sheet that is made of a flexible material and is hung from one side wall of said cage to the other side wall and is spaced from the back wall of the cage by a distance from about one foot to three feet, said deflector sheet being secured along its upper side edge to the top wall of the cage, said deflector sheet further having a curved slit in the upper portion thereof, with the curved slit curving downwardly from near said upper edge of the deflector sheet.

24. A golf ball teeing device in accordance with claim 19 wherein said cage further includes a planar deflector member that extends from the upstanding wall of said tray, said planar deflector member extending outwardly and downwardly from the top of said upstanding wall of said tray so that when said golf ball is hit low along the ground toward said cage, the planar deflector member deflects said golf ball into the cage instead of ricocheting said golf ball back toward the person that hit the golf ball.

25. A golf ball teeing device in accordance with claim 24 wherein said planar deflector member has an upper surface that is covered by a layer of foamed polymeric material, with a sheet of material covering the layer of foamed polymeric material.

* * * * *